US009908348B2

(12) United States Patent
Kumai et al.

(10) Patent No.: US 9,908,348 B2
(45) Date of Patent: Mar. 6, 2018

(54) LIQUID EJECTING APPARATUS

(71) Applicant: SEIKO EPSON CORPORATION, Tokyo (JP)

(72) Inventors: Eiji Kumai, Matsumoto (JP); Yoji Takahashi, Matsumoto (JP); Osamu Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/861,683

(22) Filed: Sep. 22, 2015

(65) Prior Publication Data

US 2016/0089900 A1 Mar. 31, 2016

(30) Foreign Application Priority Data

Sep. 25, 2014 (JP) ..... 2014-194903

(51) Int. Cl.
*B41J 11/00* (2006.01)
*B41J 15/04* (2006.01)

(52) U.S. Cl.
CPC ..... *B41J 15/046* (2013.01); *B41J 11/002* (2013.01); *B41J 11/0005* (2013.01); *B41J 11/0015* (2013.01)

(58) Field of Classification Search
CPC . B41J 15/02; B41J 15/046; B41J 15/16; B41J 11/0005; B41J 11/002
See application file for complete search history.

(56) References Cited

U.S. PATENT DOCUMENTS 8,708,476 B2 4/2014 Sasaki
2012/0162334 A1* 6/2012 Sasaki ..... B41J 15/16 347/102
2013/0063534 A1* 3/2013 Akamine ..... B41J 11/002 347/102

FOREIGN PATENT DOCUMENTS

JP 2003-063082 A 3/2003
JP 2004-090484 A 3/2004
JP 2012-139822 A 7/2012

* cited by examiner

*Primary Examiner* — Kristal Feggings
*Assistant Examiner* — Kendrick Liu
(74) *Attorney, Agent, or Firm* — Workman Nydegger

(57) ABSTRACT

A liquid ejecting apparatus includes an ejecting unit which can eject liquid in an ejecting region: and a medium support unit which can support a medium on a downstream side in a transport direction of the medium compared to the ejecting region, in which the medium support unit has a first region which has at least one face, and a second region which is located between the ejecting region and the first region, and has a plurality of bent portions, and in which the length of a face between the bent portions in the second region in the transport direction is shorter than the length of a face included in the first region in the transport direction.

8 Claims, 2 Drawing Sheets

LIQUID EJECTING APPARATUS

BACKGROUND

1. Technical Field

The present invention relates to a liquid ejecting apparatus.

2. Related Art

In the related art, a recording apparatus which includes, for example, an adjusting unit which causes a support face to protrude upward toward the center portion from both end portions in a width direction which is orthogonal to a transport direction in which a recording medium is transported, and can adjust a protruding amount at the center portion according to the amount of thermal expansion of the recording medium in the width direction which is caused by heating using a heating unit has been known (for example, refer to JP-A-2012-139822).

However, the support face in the apparatus is bent at regular intervals over the entire support face in the transport direction. For this reason, when there are wrinkles on a medium, there is a problem in that the wrinkles on the medium progress to an ejecting region of a recording head, and image quality deteriorates.

SUMMARY

The invention can be realized in the following forms or application examples.

Application Example 1

According to this application example, there is provided a liquid ejecting apparatus including an ejecting unit which can eject liquid in an ejecting region; and a medium support unit which can support a medium on a downstream side in a transport direction of the medium compared to the ejecting region, in which the medium support unit has a first region which has at least one face, and a second region which is located between the ejecting region and the first region, and has a plurality of bent portions, and the length of a face between the bent portions in the second region in the transport direction is shorter than the length of a face included in the first region in the transport direction.

According to the configuration, a plurality of bent portions are provided in the second region, and are configured so as to become shorter than the length of a face in the first region in the transport direction. By doing so, since the progression of wrinkles in the second region is regulated even when the wrinkles of a medium progress toward the upstream side from the downstream side of an ejecting region, it is possible to suppress progressing of the wrinkles to the ejecting region. Accordingly, it is possible to suppress deterioration in image quality.

Application Example 2

In the liquid ejecting apparatus according to the application example, the area of the second region is smaller than that of the first region.

According to the configuration, it is possible to effectively suppress progressing of wrinkles by intensively providing bent portions in the second region of which the area is relatively small.

Application Example 3

In the liquid ejecting apparatus according to the application example, the number of faces included in the second region is larger than the number of faces included in the first region.

According to the configuration, it is also possible to form many bent portions relatively, by making a face in the second region relatively large. For this reason, it is possible to effectively suppress progressing of wrinkles.

Application Example 4

In the liquid ejecting apparatus according to the application example, the bent portion is bent in a mountain fold shape when viewed from a side supporting the medium.

According to the configuration, it is possible to suppress progressing of wrinkles of a medium while maintaining adhesion between the bent portion and the medium.

Application Example 5

In the liquid ejecting apparatus according to the application example, the medium support unit includes a heater which can heat the medium.

According to the configuration, it is possible to dry liquid which is applied onto a medium using a heater. In addition, when heating the medium using the heater, wrinkles easily occur on the medium due to thermal expansion, or the like; however, it is possible to suppress progressing of wrinkles to the ejecting region using the bent portion which is provided in the second region.

Application Example 6

The liquid ejecting apparatus according to the application example may further include a heater which is provided at a position facing the medium support unit, and can heat the medium.

According to the configuration, it is possible to efficiently dry liquid which is applied onto a medium from a position facing the medium support unit. In addition, when heating the medium using the heater, wrinkles easily occur on the medium due to thermal expansion, or the like; however, it is possible to suppress progressing of wrinkles to the ejecting region using the bent portion which is provided in the second region.

Application Example 7

In the liquid ejecting apparatus according to the application example, in the second region, a plurality of the bent portions are provided along a virtual curve.

According to the configuration, it is possible to suppress progressing of wrinkles of the medium while maintaining adhesion between the bent portion and the medium.

Application Example 8

In the liquid ejecting apparatus according to the application example, a radius of curvature of the virtual curve is 100 mm or more and 200 mm or less.

According to the configuration, it is possible to preferably suppress progressing of wrinkles of the medium while maintaining adhesion between the bent portion and the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to drawings. In each of the following figures, scales in each member, or the like, are denoted using scales which are different from real scales so as to make the size of each member recognizable.

First, a configuration of a liquid ejecting apparatus will be described. The liquid ejecting apparatus includes an ejecting unit which can eject liquid in an ejecting region, a medium support unit, or the like, which can support a medium on a downstream side in a transport direction of a medium compared to the ejecting region. The liquid ejecting apparatus is an ink jet printer, for example. According to the embodiment, a large format printer (LFP) which treats relatively large media (medium) will be described as a configuration example of the liquid ejecting apparatus.

Figure 1:
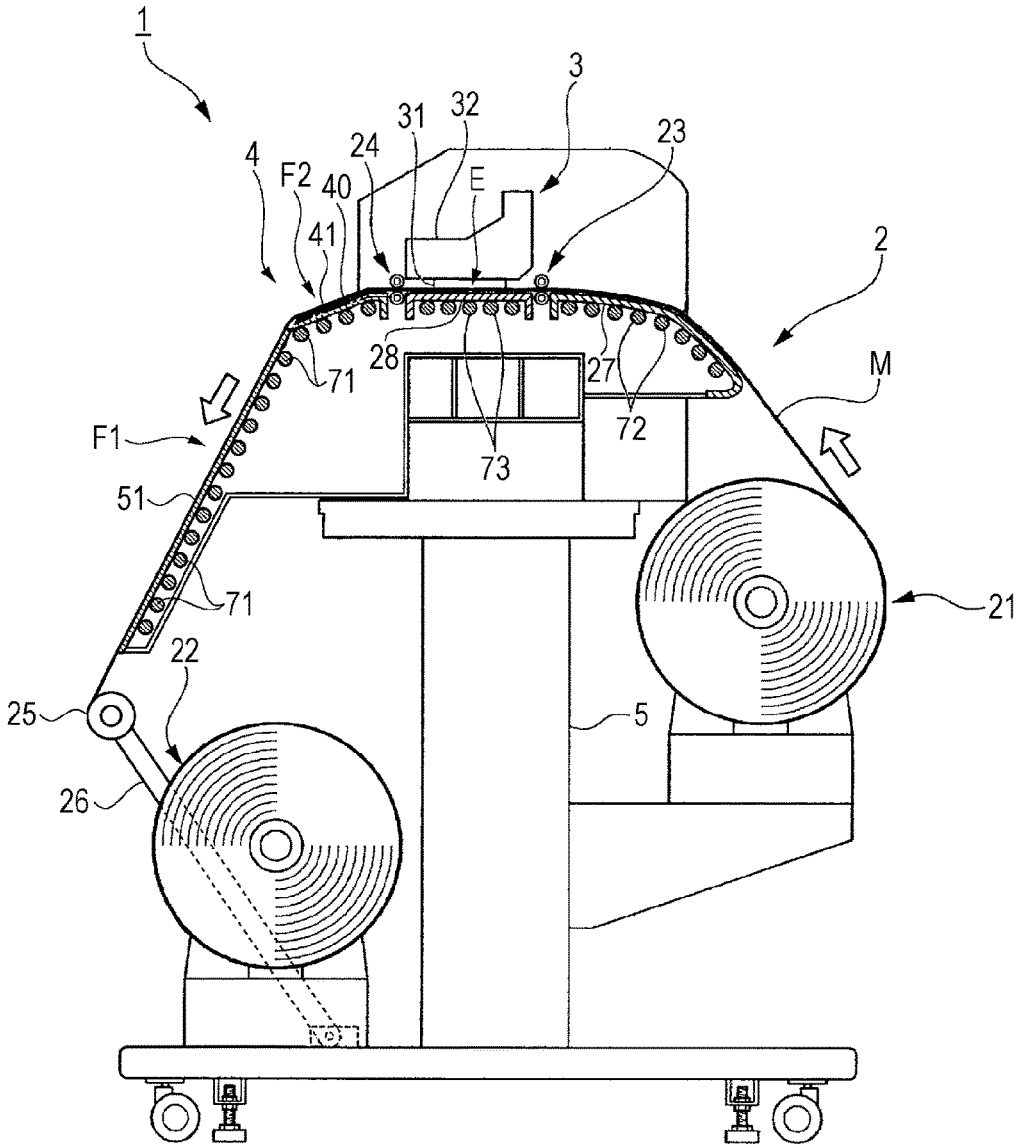
FIG. 1 is a schematic diagram which illustrates a configuration of a liquid ejecting apparatus.

FIG. 1 is a schematic diagram which illustrates a configuration of a liquid ejecting apparatus. As illustrated in FIG. 1, a liquid ejecting apparatus 1 includes a transport unit 2 which transports a medium M using a roll-to-roll method, an ejecting unit 3 which ejects (discharges) ink as liquid to a predetermined region of the medium M, and records an image, characters, or the like, a medium support unit 4 which supports the medium M, and the like. In addition, each configuration unit of these is supported by a main body frame 5. In addition, the medium M is a vinyl chloride film, or the like, which has a width of approximately 64 inches, for example.

The transport unit 2 includes a roll 21 which sends a medium M in a roll shape in the transport direction (arrow direction in figure), and a roll 22 which winds up the sent medium M. The transport unit 2 includes a pair of transport rollers 23 and 24 which transport the medium M in a transport path between the rolls 21 and 22. In addition, the transport unit 2 includes a tension roller 25 which applies a tensile force to the medium M in the transport path between the transport roller 24 and the roll 22.

The tension roller 25 is supported by an oscillating frame 26, and has a configuration of being in contact with the rear surface of the medium M in the width direction (perpendicular direction on paper face in FIG. 1). The tension roller 25 is formed so as to be longer than the width of the medium M in the width direction. The tension roller 25 is provided on the downstream side in the transport direction compared to the medium support unit 4.

The ejecting unit 3 includes a recording head (ink jet head) 31 which ejects ink with respect to the medium M which is supported by a platen 28 which is arranged in the transport path between the pair of transport rollers 23 and 24, and a carriage 32 which freely reciprocates in the width direction of the medium M by mounting a recording head 31 thereon. The recording head 31 includes a plurality of nozzles, and has a configuration in which ink, as an example of liquid, in which permeation drying or evaporation drying is necessary by being selected in relation to the medium M, can be ejected. In addition, it is possible to record an image, characters, and the like, on the medium M by causing ink to be ejected from the recording head 31 while causing the carriage 32 to reciprocate. Here, a region in which ink can be ejected from the recording head 31 due to a movement of the carriage 32 corresponds to an ejecting region (region in which ejecting can be performed) E. In conclusion, the liquid ejecting apparatus includes the ejecting unit 3 which can eject liquid in the ejecting region E.

The medium support unit 4 can support the medium M on the downstream side in the transport direction of the medium M compared to the ejecting region E. That is, the liquid ejecting apparatus includes the medium support unit 4 which can support the medium M on the downstream side in the transport direction of the medium M compared to the ejecting region E. The medium support unit 4 has a first region F1 which has at least one face 51 and a second region F2 which is located between the ejecting region E and the first region F1, and includes a plurality of bent portions 40. The second region F2 includes a plurality of faces 41. In addition, a detailed configuration of the medium support unit 4 will be described later.

The medium support unit 4 includes a first heater 71 as a heater which can heat the medium M. The first heater 71 has a configuration in which ink is rapidly fixed onto the medium M using drying by heating the medium M, and image quality is improved by preventing bleeding or blurring. According to the embodiment, the first heater 71 is arranged on a face side opposite to a face supporting the medium M (rear surface) in the medium support unit 4. The first heater 71 is a tube heater, for example, and is affixed to the rear surface of the medium support unit 4 through aluminum tape, or the like. In addition, when the first heater 71 is driven, a face in the medium support unit 4 which supports the medium M is heated due to heat conduction, and it is possible to heat the medium M from the rear side of the medium M.

According to the embodiment, a second heater (preheater) 72, and a third heater (platen heater) 73 are included, in addition to the first heater 71 which is arranged in the medium support unit 4. The second heater 72 preheats the medium M on the upstream side in the transport direction compared to a position in which the ejecting unit 3 is provided. The second heater 72 is provided between the roll 21 and the transport roller 23, and is arranged on a face side opposite to a face (rear surface) which supports the medium M in a supply support unit 27 which supports the medium M. The third heater 73 heats the medium M in the ejecting region E of the ejecting unit 3. The third heater 73 is arranged on a face side opposite to a face (rear face) of the platen 28 which supports the medium M. The second heater 72 and the third heater 73 are configured as tube heaters similar to the first heater 71 which is arranged in the medium support unit 4, and are affixed to predetermined positions using aluminum tape, or the like.

For example, the heating temperature of the second heater 72 is set to 40° C., and the heating temperature of the third heater 73 is set to 40° C. (target temperature). In addition, the heating temperature of the first heater 71 is set to 50° C. which is higher than those of the second heater 72 and the third heater 73.

The second heater 72 is configured so as to urge ink to be rapidly dried from the time of landing by gradually raising the temperature of the medium M from room temperature to a target temperature (temperature in the third heater 73). The third heater 73 is configured so as to urge ink to be rapidly dried from a time of landing by causing the medium M to receive landing of ink in a state in which the target temperature is maintained. The first heater 71 is configured so that the temperature of the medium M is raised to a temperature that is higher than the target temperature, ink which landed on the medium M, and is not dried yet is rapidly dried, and the landed ink is caused to be completely fixed onto the medium M by being dried, at least before being wound up around the roll 22.

In this manner, since the heating temperature of the first heater 71 is set to be higher than those of the second heater 72 and the third heater 73, thermal expansion of the medium M easily occurs, relatively, compared to other heating units. Since a tensile force is applied to the medium M using the tension roller 25 in the first heater 71, a portion of thermal expansion of the medium M occurs at a center portion in the width direction, and it becomes wrinkled easily. As a countermeasure for this, the medium support unit 4 according to the embodiment has the following configuration.

Figure 2A:
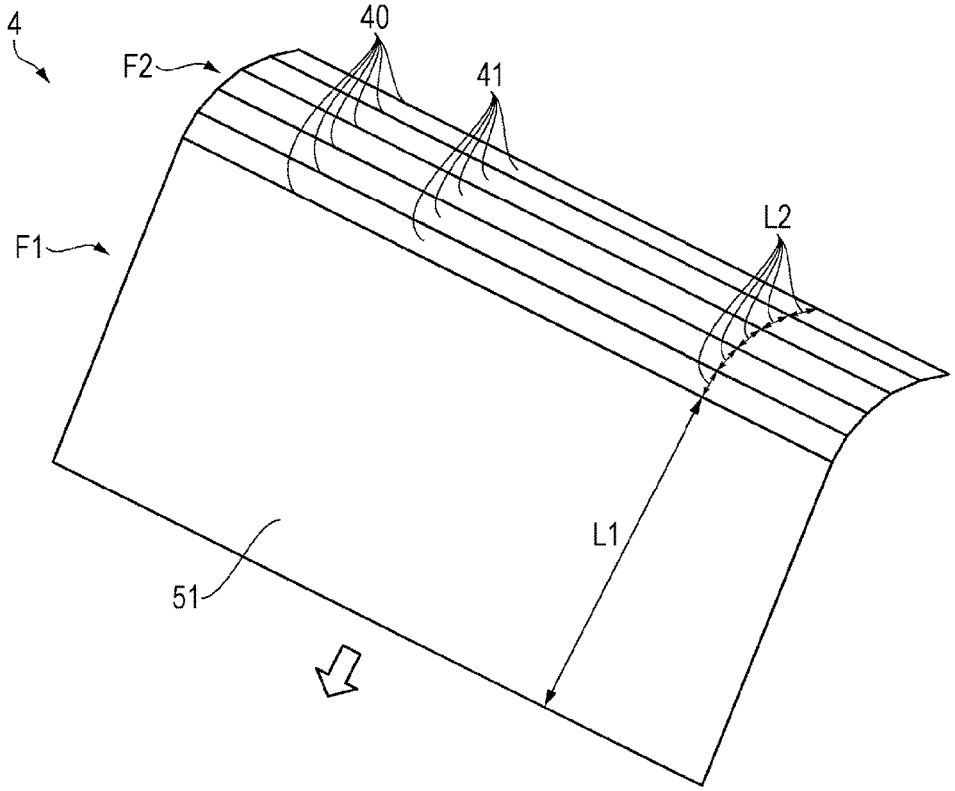
FIGS. 2A and 2B are schematic diagrams which illustrate a configuration of a medium support unit.
Figure 2B:
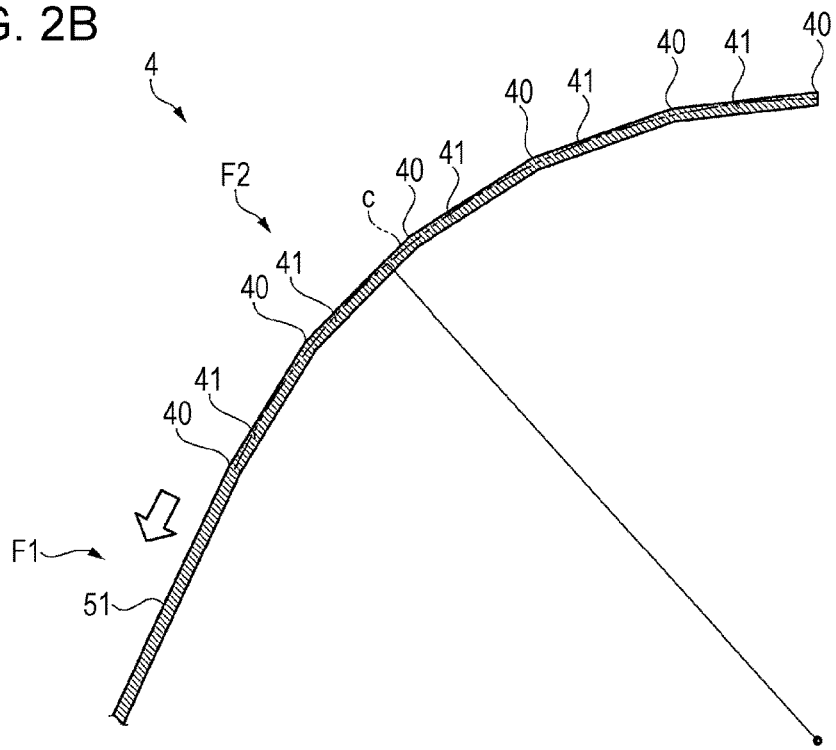

Subsequently, a configuration of the medium support unit will be described. FIGS. 2A and 2B illustrate the configuration of the medium support unit, in which FIG. 2A is a perspective view which illustrates the configuration of the medium support unit, and FIG. 2B is a sectional view of a part which illustrates the configuration of the medium support unit.

As illustrated in FIG. 2A, the medium support unit 4 includes the first region F1 which has one face 51. The first region F1 may have at least one face 51; however, it may be a configuration in which the first region has a plurality of faces 51. The medium support unit 4 is located between the ejecting region E (refer to FIG. 1) and the first region F1, and has the second region F2 which has the plurality of bent portions 40. The second region F2 has a plurality of faces 41. Specifically, the second region F2 has five faces 41. However, the number of faces 41 may be four or less, or six or more. At this time, a portion between faces 41 becomes the bent portion 40. In addition, an end portion on the upstream side in the transport direction, and an end portion on the downstream side in the transport direction of the second region F2 becomes the bent portion 40. According to the embodiment, six bent portions 40 are provided. However, the number of the bent portions 40 may be five or less, or seven or more. The medium support unit 4 is formed of a steel plate, and more specifically, formed of a cold rolled steel plate (SPCC). The medium support unit 4 is formed to be longer than the width of the medium M in the width direction, and more specifically, is formed to be longer than a width of approximately 64 inches.

The length L2 of the face 41 between the bent portions 40 in the second region F2 in the transport direction is set to be shorter than the length L1 of the face 51 included in the first region F1 in the transport direction.

In addition, an area of the second region F2 is configured so as to be smaller than an area of the first region F1. The number of faces 41 included in the second region F2 is set to be larger than the number of faces 51 which are included in the first region F1, as illustrated in FIG. 2. According to the embodiment, the number of faces 41 included in the second region F2 is set to 5 while the number of faces 51 included in the first region F1 is 1. That is, the plurality of bent portions 40 are intensively provided in the second region F2 of which the area is relatively smaller than that of the first region F1.

The bent portion 40 in the second region F2 is bent in a mountain fold shape when viewed from a side on which the medium M is supported, as illustrated in FIG. 2B. In other words, the bent portion 40 forms a convex shape which is approximately curved toward the face 41 on which the medium M is supported. In the second region F2 according to the embodiment, the plurality of bent portions 40 are formed along a virtual curve c. A radius curvature r of the virtual curve c is arbitrarily set in a range of 100 mm or more and 200 mm or less. At this time, the curvature is defined according to a reciprocal of the radius curvature. Here, when a curvature of the bent portion 40 in the second region F2 becomes large (curving state becomes tight, or radius curvature becomes small), for example, when transporting a medium M which is relatively thick, the medium M floats from the face 51 of the first region F1, and the face 41 of the second region F2, and as a result, insufficient heating occurs. On the other hand, when the curvature of the bent portion 40 in the second region F2 becomes small (curving state becomes loose, or radius curvature becomes large), it is possible to suppress floating of the medium M from the face 51 of the first region F1, and the face 41 of the second region F2; however, an effect of suppressing progressing of wrinkles of the medium M is reduced. For this reason, when wrinkles occur in the medium M due to thermal expansion, or the like, there is a concern that the wrinkles may progress to the ejecting region E. Accordingly, it is preferable to appropriately set the curvature (radius of curvature) of the bent portion 40 in the second region F2 according to a medium M, or the like, which will be used.

As described above, according to the embodiment, it is possible to obtain the following effects.

The transport unit 2 is driven, and the medium M is transported toward the ejecting unit 3 from the roll 21. In addition, ink is ejected from the recording head 31 of the ejecting unit 3 toward the transported medium M, and the ink is applied onto the medium M. Thereafter, the medium M is transported to the medium support unit 4. In addition, the medium M is heated using the first heater 71 which is arranged in the medium support unit 4. When the medium M is heated, there is a case in which wrinkles occur in the medium M due to thermal expansion, or the like. Here, the medium support unit 4 is configured of the first region F1 and the second region F2, and the second region F2 is configured of the plurality of bent portions 40 which are formed along the virtual curve c. A curvature due to the virtual curve c is formed to be relatively large. That is, in the second region F2, a curving state becomes tight due to the plurality of bent portions 40 compared to the first region F1. For this reason, even when wrinkles occur in the medium M, progressing of the wrinkles to the ejecting region E is regulated by the bent portion 40 of the second region F2. Accordingly, it is possible to suppress deterioration in image quality.

The invention is not limited to the above described embodiment, and it is possible to add various modifications, improvement, or the like, to the above described embodiment. Modification Examples will be Described Below

Modification Example 1

In the above described embodiment, the first heater 71 which is arranged on the downstream side in the transport direction compared to the ejecting region E is affixed to the rear surface of the medium support unit 4; however, its arrangement position is not limited to the configuration. For example, a heater which is arranged on the downstream side in the transport direction compared to the ejecting region E may be provided at a position facing the medium support unit 4 so as to heat the medium M. In other words, the liquid ejecting apparatus may have a configuration of including a heater which is provided at a position facing the medium support unit 4, and can heat the medium M. That is, it may be a configuration of heating the medium M from a face side of the medium M onto which ink is applied using the ejecting unit 3. By doing so, it is also possible to obtain an effect which is the same as the above described effect.

Modification Example 2

As the liquid ejecting apparatus, a liquid ejecting apparatus which ejects liquid other than ink may be adopted. For example, the liquid ejecting apparatus may be used in various recording apparatuses which include a recording head, or the like, which ejects liquid droplets of a minute amount. The liquid droplets mean a state of the liquid which is ejected from the above described recording apparatus, and include a granular shape, a tear shape, or a thread shape leaving a trail. The liquid referred to here may be a material which can be ejected (discharged) by the liquid ejecting apparatus. For example, the material may be a material in a state of a liquid phase, may include a liquid body having high or low viscosity, a fluidal body such as sol, gel water, and inorganic solvents, organic solvents, liquid, liquid resins, liquid metals (metallic melt) other than that, or materials in which particles of a functional material which is formed of a solid body such as a pigment or metal particles are melted, diffused, or mixed in a solvent, not only as liquid as a state of the material. In addition, as a representative example of the liquid, there is ink as described in the above embodiments. Here, the ink includes general water-based ink and oil-based ink, and a variety of liquid compositions such as gel ink, hot-melt ink, or the like. In addition, a recording medium includes functional paper which performs thermal expansion so as to be thin, a substrate, a metal plate, or the like, in addition to a plastic film such as a vinyl chloride film.

The entire disclosure of Japanese Patent Application No. 2014-194903, filed Sep. 25, 2014 is expressly incorporated reference herein.

What is claimed is:

1. A liquid ejecting apparatus comprising:

an ejecting unit which can eject liquid in an ejecting region; and a medium support unit which can support a medium on a downstream side in a transport direction of the medium compared to the ejecting region, wherein the medium support unit has a first region which has a planar face extending from a downstream end of the medium support unit towards the ejecting region, and a second region which is located between the ejecting region and the first region, and has a plurality of bent portions and a plurality of faces, each face of the plurality of faces being bounded in the transport direction by bent portions of the plurality of bent portions, and wherein a length of each face between the bent portions in the second region in the transport direction is shorter than a length of the planar face included in the first region in the transport direction, wherein the length of each face in the second region is less than half of the length of the face in the first region, and wherein each face extends generally downwardly away from the ejecting unit.

2. The liquid ejecting apparatus according to claim 1, wherein the area of the second region is smaller than that of the first region.

3. The liquid ejecting apparatus according to claim 1, wherein the number of faces included in the second region is larger than the number of faces included in the first region.

4. The liquid ejecting apparatus according to claim 1, wherein the bent portion is bent in a mountain fold shape when viewed from a side supporting the medium.

5. The liquid ejecting apparatus according to claim 1, wherein the medium support unit includes a heater which can heat the medium.

6. The liquid ejecting apparatus according to claim 1, further comprising:

a heater which is provided at a position facing the medium support unit, and can heat the medium.

7. The liquid ejecting apparatus according to claim 1, wherein, in the second region, a plurality of the bent portions are provided along a virtual curve.

8. The liquid ejecting apparatus according to claim 7, wherein a radius of curvature of the virtual curve is 100 mm or more and 200 mm or less.

* * * * *